US012781464B2

(12) United States Patent
Schuell et al.

(10) Patent No.: US 12,781,464 B2
(45) Date of Patent: Nov. 3, 2026

(54) GRAB DEVICE AND METHOD FOR OPERATING A GRAB DEVICE

(71) Applicant: BAUER Maschinen GmbH, Schrobenhausen (DE)

(72) Inventors: Andreas Schuell, Gerolsbach (DE); David Pfeiffer, Schrobenhausen (DE); Andreas Hugl, Burgheim (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 352 days.

(21) Appl. No.: 18/294,276

(22) PCT Filed: Aug. 4, 2022

(86) PCT No.: PCT/EP2022/071951
§ 371 (c)(1),
(2) Date: Feb. 1, 2024

(87) PCT Pub. No.: WO2023/016914
PCT Pub. Date: Feb. 16, 2023

(65) Prior Publication Data

US 2024/0337088 A1 Oct. 10, 2024

(30) Foreign Application Priority Data

Aug. 12, 2021 (EP) ..... 21191049

(51) Int. Cl.
*E02F 3/47* (2006.01)

(52) U.S. Cl.
CPC ..... *E02F 3/475* (2013.01)

(58) Field of Classification Search
USPC ..... 37/398, 394, 395, 401
See application file for complete search history.

(56) References Cited

U.S. PATENT DOCUMENTS 3,303,590 A * 2/1967 Grospas ..... E02F 3/47 37/461
2005/0000124 A1* 1/2005 Rohr ..... E02F 3/47 37/398
2021/0047151 A1* 2/2021 Goto ..... B66C 23/42

FOREIGN PATENT DOCUMENTS

DE 19933771 A1 1/2001
EP 3798367 A1 3/2021
(Continued)

OTHER PUBLICATIONS

JP-2000255973-A (Year: 2000).*
(Continued)

*Primary Examiner* — Christopher J Sebesta
*Assistant Examiner* — Evan A Bregel
(74) *Attorney, Agent, or Firm* — Studebaker Brackett PLLC

(57) ABSTRACT

The invention relates to a grab device with a carrier implement and a rope grab arranged thereon which has a grab frame which is held on the carrier implement via a holding rope, at least two grab shovels which are pivotably supported on a lower end of the grab frame between a closed position and an open position, and an actuating means with an actuating rope for pivoting the grab shovels, wherein an actuating rope is guided from the carrier implement to the actuating means and the carrier implement has a driven first rope winch for the holding rope and a driven second rope winch for the actuating rope. In accordance with the invention provision is made in that a first detection means for detecting a first rope force on the holding rope and a second detection means for detecting a second rope force on the actuating rope are provided and in that a control means is provided which is connected to the first detection means, the second detection means, the first rope winch and the second rope winch and which, depending on the detected first rope
(Continued)

Figure 1:
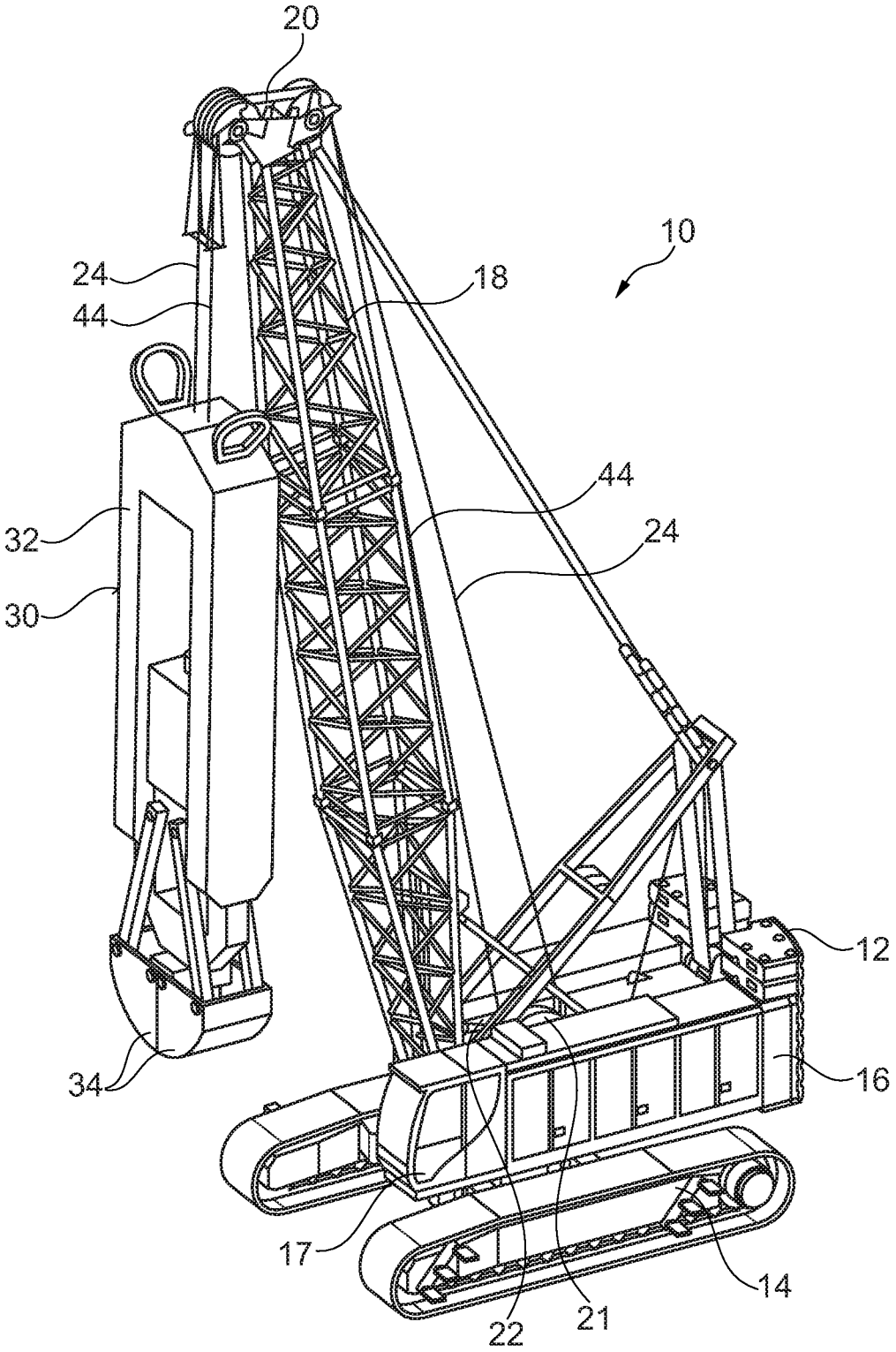

force on the holding rope and the detected second rope force on the actuating rope, is designed to activate the first rope winch and/or the second rope winch according to a control program specification.

13 Claims, 3 Drawing Sheets

(56) References Cited

FOREIGN PATENT DOCUMENTS

| | | | | |
|---|---|---|---|---|
| GB | 2126981 | A | | 4/1984 |
| JP | H03-241118 | A | | 10/1991 |
| JP | H09-158254 | A | | 6/1997 |
| JP | 2000255973 | A | * | 9/2000 |
| JP | 2001-064993 | A | | 3/2001 |
| JP | 2003-048684 | A | | 2/2003 |
| JP | 2003-147800 | A | | 5/2003 |
| JP | 2003-247247 | A | | 9/2003 |
| JP | 2004293069 | A | * | 10/2004 |
| JP | 2016-074524 | A | | 5/2016 |

OTHER PUBLICATIONS

JP-2004293069-A (Year: 2004).*
International Preliminary Report on Patentability and Written Opinion issued in PCT/EP2022/071951; issued Feb. 13, 2024.
"Notice of Reasons for Refusal" Office Action issued in JP 2024-508708; mailed by the Japanese Patent Office on Oct. 8, 2024.
International Search Report issued in PCT/EP2022/071951; mailed Nov. 17, 2022.

* cited by examiner

GRAB DEVICE AND METHOD FOR OPERATING A GRAB DEVICE

The invention relates to a grab device with a carrier implement and a rope grab arranged thereon which has a grab frame which is held on the carrier implement via a holding rope, at least two grab shovels which are pivotably supported on a lower end of the grab frame between a closed position and an open position, and an actuating means with an actuating rope for pivoting the grab shovels, wherein the actuating rope is guided from the carrier implement to the actuating means and the carrier implement has a driven first rope winch for the holding rope and a driven second rope winch for the actuating rope, in accordance with the preamble of claim 1.

The invention further relates to a method for operating a grab device in accordance with the preamble of claim 13.

In specialist foundation engineering grab devices are used to produce trenches in the ground. In the trenches diaphragm walls can be produced to retain and/or seal excavation pits.

Grab devices primarily comprise a grab with grab shovels, wherein the grab is suspended via a holding rope on a carrier implement, typically a boom crane. With the holding rope a grab can be lowered into the ground. By closing the grab shovels ground material can be removed and received in the grab. Subsequently, by way of the holding rope the grab is withdrawn again from the ground and pivoted with the carrier implement to an emptying position, in which the grab shovels are opened to release the ground material. Afterwards the grab is pivoted back into the working position and introduced into the trench in the ground for a renewed grabbing process.

There are two different types of grabs that are employed on such grab devices, namely hydraulic grabs and rope grabs. A so-called hydraulic grab is known from EP 3 798 367 A1 for example. In a hydraulic grab the movement for opening and closing the grab shovels is generated by a hydraulic cylinder that is arranged on the grab frame.

Such hydraulic grabs can be operated and controlled relatively easily by the hydraulic system. However, for the supply and discharge of hydraulic fluid suitable hydraulic lines are required that run parallel to the holding rope. On the carrier implement corresponding line drums for the hydraulic lines with respective winch drives as well as a correspondingly designed hydraulic unit have to be provided. This makes the grab device correspondingly larger and also more cost-intensive. What is more, the hydraulic system requires an additional amount of maintenance.

By comparison, so-called rope grabs offer a considerably simplified construction. A rope grab of such type is known from GB 2 126 981 A for example. In a rope grab the opening and closing movement of the grab shovels is brought about by an actuating rope. The actuating rope substantially runs parallel to the holding rope from the actuating means of the grab shovels to the carrier implement. By means of a separate winch for the actuating rope an opening or closing of the grab shovels can be achieved by winding off or winding up the actuating rope onto the winch.

In a rope grab the complex supplies of hydraulic lines to the grab can be dispensed with. All that is necessary is to provide an additional actuating rope with a corresponding winch. Such an actuating rope also requires considerably less maintenance as compared to hydraulic lines with a corresponding hydraulic system.

However, the operation of a rope grab is not as easy as in the case of a hydraulic grab as this requires an experienced machine operator. One reason for this mainly lies in the fact that due to the double arrangement of a rope, namely the holding rope and the actuating rope, torques causing a certain turning of the rope grab about its longitudinal axis are generated in different operating states. However, a precise rotational position of the rope grab is essential in order that the rope grab, when being returned from the emptying position, can again be introduced into a trench already produced in the ground.

A rotational position of the rope grab about its longitudinal axis can be brought about by a machine operator by applying specific pull forces onto the holding rope and the actuating rope. For this a relatively sensitive operation of the respective rope winches is necessary. On the part of the machine operator this requires a certain experience and also high concentration when carrying out the method. Moreover, rope winches are often operated by foot pedals so that a sensitive operation of the rope winches for several hours is also very exhausting for a machine operator.

The invention is based on the object to provide a grab device and a method for operating the grab device, with which a simple construction of the grab device is still given while at the same time enabling easy operation.

The object is achieved on the one hand by a grab device having the features of claim 1 and on the other hand by a method having the features of claim 13. Particular embodiments of the invention are stated in the respective dependent claims.

The grab device according to the invention is characterized in that a first detection means for detecting a first rope force on the holding rope and a second detection means for detecting a second rope force on the actuating rope are provided and in that a control means is provided which is connected to the first detection means, the second detection means, the first rope winch and the second rope winch and which, depending on the detected first rope force on the holding rope and the detected second rope force on the actuating rope, is designed to activate the first rope winch and/or the second rope winch according to a control program specification.

The invention is based on the finding that a torque on a rope grab about its longitudinal axis depends on the rope forces in the holding rope and the actuating rope. According to an aspect of the invention detection means are therefore provided, with which a rope force on the holding rope and a rope force on the actuating rope are detected. The force values detected in each case can be forwarded to a control means that controls a first rope winch for the holding rope and a second rope winch for the actuating rope according to inputs and specifications by the machine operator. Hence, through the control means it is possible by way of a corresponding activation of the respective rope winch (rope wind-up/wind-off) that the forces in the holding rope and in the actuating rope can be matched to each other so that in the case of a given or desired rotational position of the rope grab in particular no torque about the longitudinal axis is generated onto the said rope grab by the holding rope and the actuating rope. Basically, by influencing the respective rope forces accordingly, the control means can also be used to generate a defined (variable) torque for a desired turning.

Furthermore, the invention is based on the finding that especially when normally using steel ropes made of coiled steel wires or strands a so-called rope lay is present which, in the case of steel ropes that are not of low-rotation or rotation-resistant nature, leads to a torque about the longitudinal axis of the rope when corresponding pull forces are applied to the steel rope. Provided that the holding rope and the actuating rope show an opposing direction of lay, the matching of the pull forces in the holding rope and the actuating rope can bring about a compensation of these torques generated by the ropes. By preference, this can be achieved in a particularly easy way if ropes of identical or similar structure are used which, however, have an opposing direction of lay. When using two ropes of opposing rope lay that are attached to one body an equilibrium of torques, a left-hand or right-hand rotary torque can be generated on the body when a corresponding distribution of pull force is present. The holding rope can preferably be fixed on an upper or lower region of the grab frame or the actuating means.

A preferred embodiment of the invention resides in the fact that by the control program specification of the control means a defined ratio between the first rope force in the holding rope and the second rope force in the actuating rope is specified and can be set. In the control program specification allowances for correspondingly identical or different designs of holding rope and actuating rope can be considered. In the case of a preferably identical design of holding rope and actuating rope which, however, have an opposing rope lay a torque compensation can be achieved by setting substantially equal pull forces in the ropes. In the case of a different design of the ropes with regard to a different rope structure allowance can be made for this and preset accordingly in the control program specification. In the control program specification additional geometric conditions on the rope grab for instance relating to different attachment points of the ropes on the grab frame can also be preset and allowed for.

Another preferred embodiment of the invention resides in the fact that the control means is designed with a compensation mode, in which the rope winches are activated such that the first rope force on the holding rope and the second rope force on the actuating rope are matched to each other. In particular, the rope winches can be activated such that the torques in the actuating rope and the holding rope compensate each other and cancel each other out. In this way, a stabilization of the rotational position of the rope grab about its longitudinal axis can be brought about. Undesired rotation of the rope grab about its longitudinal axis during operation can thus be largely avoided.

In particular, according to a further development of the invention it is advantageous that the control means is designed with a turning mode, in which the rope winches are activated such that a targeted turning of the rope grab about a vertical longitudinal axis can be generated. Starting from a stable rotational position it is then possible for a machine operator to bring about a desired change of the rotational position through appropriate actuation of the rope winches, preferably by way of an input device as for example a thumbwheel on a joystick. The control means can also be designed such that a value for or degree of a desired turning is specified by the machine operator via an input means, wherein according to the program logic the winches are actuated by the control means in such a way that the desired changed rotational position is reached.

According to a further development of the invention it is preferred that at least a third detection means for detecting a rotational position of the rope grab and/or a change of the rotational position is provided. This can take place by an optical detection means, rotary transducers, a gyroscope on the rope grab or in any other suitable way. Hence, on activation by the control means a feedback to the rotational position or to the turning of the grab can take place so that a regulation of the rotational position or of the turning can be carried out. This allows an especially precise setting of the rotational position of the rope grab.

According to another embodiment of the invention a further improvement of operability results from the fact that at least one further detection means is provided, in particular for detecting a vertical position of the rope grab, a distance and/or an angular position of the rope grab with respect to the carrier implement. The additional parameters thus detected can be displayed directly to a machine operator and/or processed by the control means to control the grab.

Another advantageous embodiment of the invention resides in the fact that an operating panel for manual control to actuate the rope grab and/or the rope winches is provided. The operating panel as input means is in particular designed such that a desired turning or movement of the rope grab is input e.g. as a numerical value or angular measure by a machine operator, preferably by way of suitable operating elements such as a cursor, a rotary wheel, switches or keys, in particular in combination with a display. Hence, a direct input of the winches and of a rotation of the winches no longer has to be carried out by the machine operator. In fact, according to the operational input as to the position of the grab the machine with the individual motors and positioning members is activated by way of the control means with the program logic in such a way that the desired position is largely reached without undesired turning movements.

According to an embodiment variant of the invention it is especially preferred that the control means is designed with an automatic program, through which the rope grab can be moved automatically to an emptying position and/or to a removal location. An automatic program can be permanently stored or, in the case of repetitive processes, can be individually defined and saved by a machine operator. In this way, larger movement sequences of the grab can be carried out automatically, in particular a movement to the emptying position and/or back to a removal location. Such movement distances of the rope grab occur with a high repetition frequency in particular when producing deep trenches in the ground.

Basically, the individual ropes can be of identical or different design. According to an embodiment of the invention it is particularly advantageous that the holding rope on the first rope winch has a first winding which is opposed to a second winding of the actuating rope on the second rope winch. In particular, the holding rope and the actuating rope have a mutually opposing direction of lay or a so-called rope lay. When a pull force is applied, torques occur on the ropes that are opposed to each other. This facilitates a compensation of the torques for positional stabilization of the rope grab during operation.

Basically, the actuating rope can be directly linked to the grab shovels. To achieve the highest possible closing forces it is advantageous in accordance with a further development of the invention that the actuating means has an actuating carriage which is connected to the grab shovels via a linkage mechanism and in that the actuating carriage is displaceable along the grab frame for pivoting the grab shovels. Preferably, the actuating carriage is supported on the grab frame by being displaceable in a longitudinal direction or vertical direction. The linkage mechanism can comprise joints, linkage rods or linkage ropes. Through an actuating carriage in particular an opening and closing movement of the grab shovels can be brought about that is as uniform as possible. This is advantageous for positional stabilization of the rope grab.

By preference, especially high closing forces can be achieved in that on the actuating carriage a pulley block arrangement is provided, with which a force increase for closing and/or opening the grab shovels can be generated. Through a pulley block arrangement, in line with the number of pulls, a multiplication of the force on the actuating rope for opening and closing the grab shovels can be achieved. The pulley block arrangement is in particular positioned between the actuating carriage and the lower end of the grab frame. The pulleys of the pulley block arrangement, which are on the one hand supported on the actuating carriage and on the other hand on the grab frame, can be looped around by the actuating rope, the lower end of which is fastened on the grab frame. This results in a corresponding extension of the distance covered by the rope to actuate the actuating carriage with the desired force increase.

According to a further embodiment of the invention it is especially advantageous that for operation a display screen for the control means is provided. The display screen can in particular be designed as a touch screen on which at least a part of the operating elements are realized for a machine operator. Furthermore, on the display screen a position of the rope grab can be displayed in different representations to further facilitate actuation for a machine operator.

The invention furthermore comprises a method for operating a grab device wherein the previously described grab device according to the invention is employed, wherein a first rope force on the holding rope is detected by means of a first detection means and a second rope force on the actuating rope is detected by means of a second detection means, and in that the first detection means, the second detection means, the first rope winch and the second rope winch are connected to a control means, by which, depending on the detected first rope force on the holding rope and the detected second rope force on the actuating rope, the first rope winch and/or the second rope winch are activated according to a control program specification.

By way of the method the previously described advantages can be achieved in conjunction with the grab device according to the invention.

The grab device can in particular be employed for different tasks. A preferred method variant resides in the fact that by means of the rope grab ground is removed and, in particular, a trench is produced in the ground. The rope grab can especially be designed as a so-called diaphragm wall grab, with which a trench can be produced for a cut-off and/or retaining wall in the ground e.g. for an excavation pit enclosure.

Figure 2:
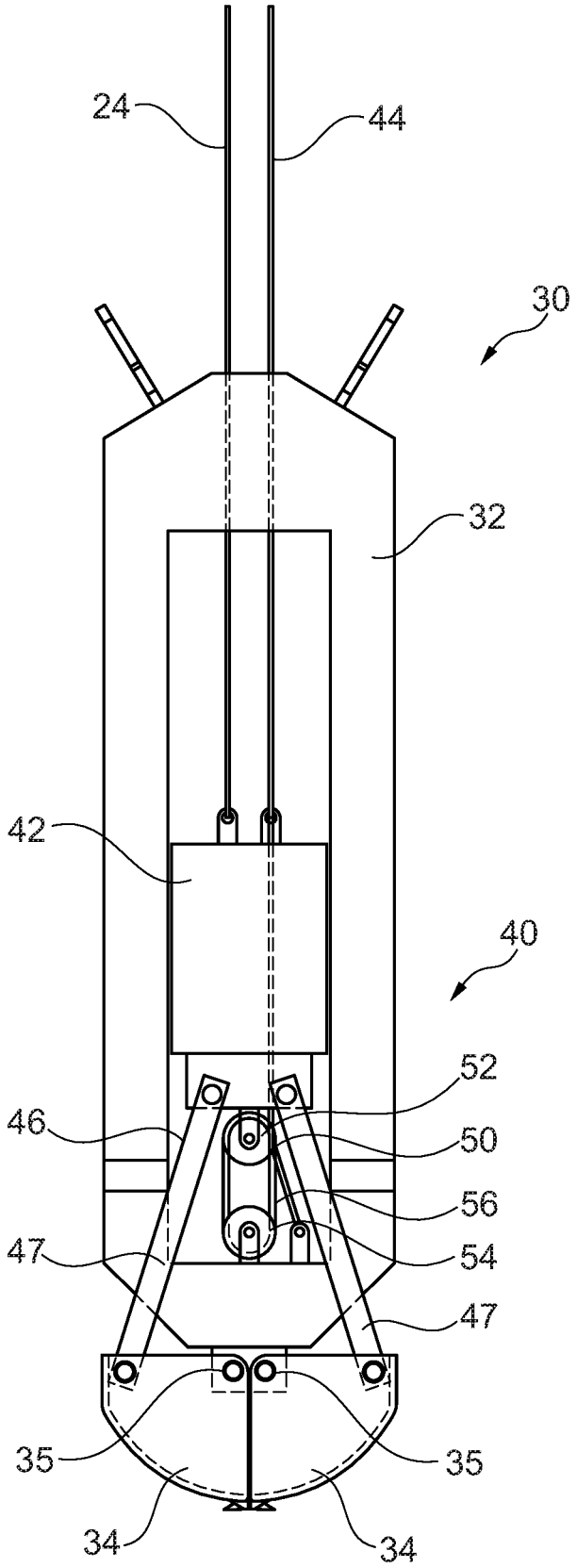
Figure 3:
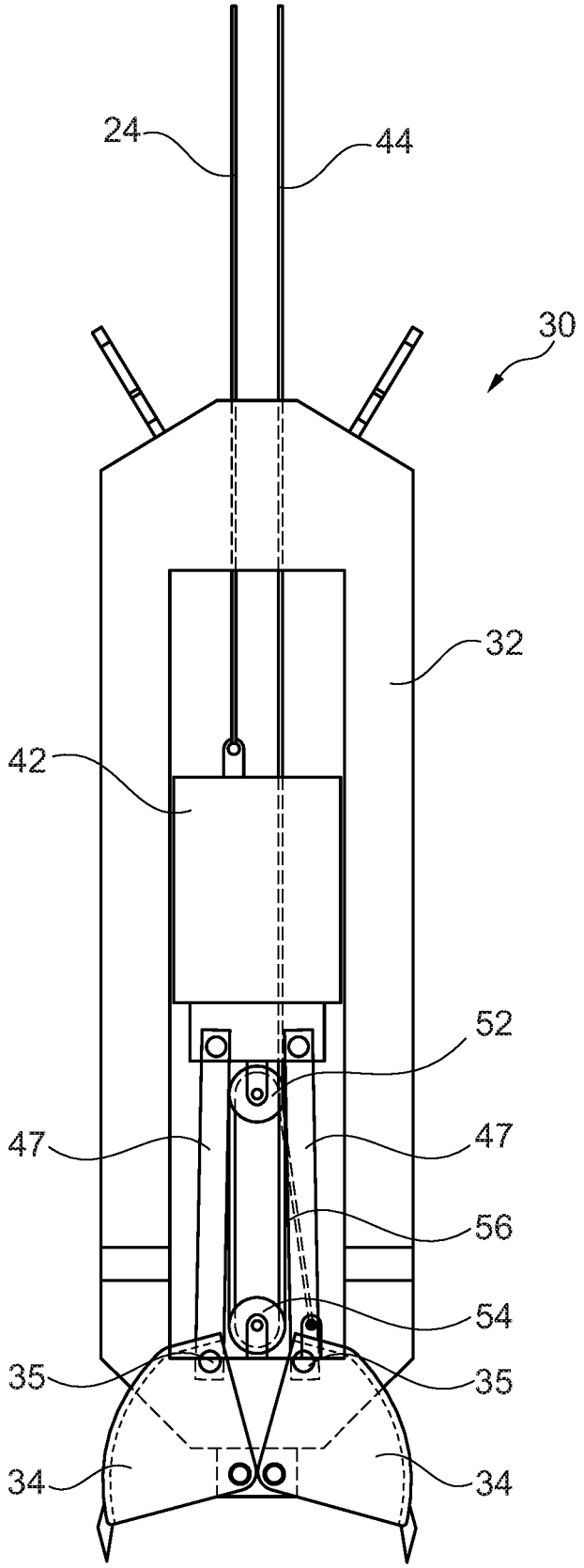

The invention is described further hereinafter by way of a preferred embodiment illustrated schematically in the drawings, wherein show FIG. 1 a perspective view of a grab device according to the invention;

FIG. 2 a front view of the rope grab of the grab device of FIG. 1 with closed grab shovels; and FIG. 3 a front view of the rope grab according to FIG. 2 with open grab shovels.

A grab device 10 pursuant to the invention and according to FIG. 1 has a mobile carrier implement 12 with a crawler-track running gear as undercarriage 14. On the undercarriage 14 an upper carriage 16 with an operator's cabin 17 is rotatably supported about a vertical axis of rotation. Inside the operator's cabin 17 a control means including an input means for a machine operator is located.

On the upper carriage 16 a boom arm 18 is pivotably linked about a horizontal axis. On a head 20 of the boom arm 18 with deflection pulleys a holding rope 24 is guided, on the end of which a rope grab 30 with a grab frame 32 and lower grab shovels 34 is suspended. By way of a first rope winch 21 on the carrier implement 12 the holding rope 24 can be actuated to lift and lower the rope grab 30. In addition, on the carrier implement 12 a second rope winch 22 for an actuating rope 44 is located which is also guided via the head 20 to the rope grab 30 to actuate the grab shovels 34 at the lower end of the grab frame 32.

The functioning of the grab device 10 according to the invention is explained in greater detail in the following in conjunction with FIGS. 2 and 3.

In a center region of the grab frame 32 an actuating carriage 42 of an actuating means 40 is displaceably supported in a vertical longitudinal direction in order to actuate the grab shovels 34. At the upper end of the actuating carriage 42 the end of the holding rope 24 is fixed so that the rope grab 30 is held via the actuating carriage 42.

At a lower end of the actuating carriage 42 a linkage mechanism 46 with linkage rods 47 is arranged. The linkage rods 47 are hinged on the one hand to the actuating carriage 42 and on the other hand to one of the grab shovels 34. The grab shovels 34 themselves are pivotably supported via pivot bearings 35 at the lower end of the grab frame 32. Through relative displacement of the actuating carriage 42 with respect to the grab frame 32 the grab shovels 34 can be opened and closed. Through relative displacement of the actuating carriage 42 in the upward direction the linkage rods 47 are pulled upwards, whereby the grab shovels 34 are pivoted about their pivot axes 35 into their open position which is illustrated graphically in FIG. 3.

Below the actuating carriage 42 a pulley block arrangement 50 for the actuating rope 44 is provided. The pulley block arrangement 50 has an upper pulley 52, which is rotatably supported on the actuating carriage 42, and a lower pulley 54, which is rotatably supported on a lower region of the grab frame 32. By forming loops 56 or pulls the pulleys 52, 54 are looped around several times by the actuating rope 44 supplied from above, while the lower end of the actuating rope 44 is firmly connected to the grab frame 32. By way of the actuating rope 44 the actuating carriage 42 is thus adjustably connected or coupled to the grab frame 32.

Starting from the open position according to FIG. 3, through upward-pulling of the actuating rope 44 by the second rope winch 22 the actuating carriage 42 is pulled by the pulley block arrangement 50 in the downward direction relative to the grab frame 32. In doing so, the linkage rods 47 press the grab shovels 34 with an increased closing force in the downward direction, whereby the grab shovels 34 are pivoted about their pivot bearings 35 into the closed position according to FIG. 2.

When used in a trench in the ground, ground material can in this way be grabbed and enclosed in-between the grab shovels 34 with a closing force that is increased with respect to the pull force on the actuating rope 44.

After withdrawing the rope grab 30 from a trench in the ground and after moving it to an emptying position the pull force on the actuating rope 44 can be reduced. As a result, the grab frame 32 is displaced due its weight force in the downward direction relative to the actuating carriage 42 so that the grab shovels 34 are pivoted via the linkage rods 47 back into their open position, as shown in FIG. 3.

This arrangement described is merely of exemplary nature. In principle, other types of pulley block arrangements with different rope linkages and a different linkage mechanism can also be chosen that enable a comparable grab shovel actuation.

When actuating the rope grab 30 a matching of the forces and movements between the holding rope 24 and the actuating rope 44 is necessary, particularly due to a so-called direction of lay in the case of coiled ropes, in order that the torques in the individual ropes and thus the torques of the suspended rope grab 30 about its longitudinal axis are controlled such that a desired rotation of the rope grab 30 only occurs if this is required for construction progress.

According to the invention, forces in the holding rope 24 and the actuating rope 44 are detected by way of corresponding detection means that can be arranged e.g. on the rope winches 21, 22 or on the deflection pulleys on the head 20 of the boom arm 18. By way of a control means, which is preferably arranged in the operator's cabin 17 on the carrier implement 12, the winches 21, 22 can be activated depending on the detected rope forces such that either a stabilization of the rotational position of the rope grab 30 about its longitudinal axis or a targeted turning desired by the machine operator is achieved. All that is required on the part of the machine operator is a corresponding input relating to a possibly desired compensation mode for positional stabilization or an input relating to a desired rotational position of the rope grab 30. Based on this the control means can activate the rope winches 21, 22 accordingly in order to bring about the desired rotational position of the rope grab 30. As a result, control of a rope grab 30 of simple construction is facilitated and made easier to a considerable degree for a machine operator.

The invention claimed is:

1. A grab device with a carrier implement and a rope grab arranged thereon which has a grab frame which is held on the carrier implement via a holding rope, at least two grab shovels which are pivotably supported on a lower end of the grab frame between a closed position and an open position, and an actuating means with an actuating rope for pivoting the grab shovels, wherein an actuating rope is guided from the carrier implement to the actuating means and the carrier implement has a driven first rope winch for the holding rope and a driven second rope winch for the actuating rope, wherein a first detection means for detecting a first rope force on the holding rope and a second detection means for detecting a second rope force on the actuating rope are provided, a control means is provided which is connected to the first detection means, the second detection means, the first rope winch and the second rope winch and which, depending on the detected first rope force on the holding rope and the detected second rope force on the actuating rope, is designed to activate the first rope winch and/or the second rope winch according to a control program specification, and the control means is designed with a turning mode, in which the rope winches are activated such that a targeted turning of the rope grab about a vertical longitudinal axis can be generated.

2. The grab device according to claim 1, wherein by the control program specification of the control means a defined ratio between the first rope force in the holding rope and the second rope force in the actuating rope is specified and can be set.

3. The grab device according to claim 1, wherein the control means is designed with a compensation mode, in which the rope winches are activated such that the first rope force on the holding rope and the second rope force on the actuating rope are matched to each other.

4. A grab device with a carrier implement and a rope grab arranged thereon which has a grab frame which is held on the carrier implement via a holding rope, at least two grab shovels which are pivotably supported on a lower end of the grab frame between a closed position and an open position, and an actuating means with an actuating rope for pivoting the grab shovels, wherein an actuating rope is guided from the carrier implement to the actuating means and the carrier implement has a driven first rope winch for the holding rope and a driven second rope winch for the actuating rope, wherein a first detection means for detecting a first rope force on the holding rope and a second detection means for detecting a second rope force on the actuating rope are provided, a control means is provided which is connected to the first detection means, the second detection means, the first rope winch and the second rope winch and which, depending on the detected first rope force on the holding rope and the detected second rope force on the actuating rope, is designed to activate the first rope winch and/or the second rope winch according to a control program specification, and at least a third detection means for detecting a rotational position of the rope grab and/or a change of the rotational position is provided.

5. The grab device according to claim 1, wherein at least one further detection means is provided, in particular for detecting a vertical position of the rope grab, a distance and/or an angular position of the rope grab with respect to the carrier implement.

6. The grab device according to claim 1, wherein the control means is designed with an automatic program, through which the rope grab can be moved automatically to an emptying position and/or to a removal location.

7. The grab device according to claim 1, wherein the holding rope on the first rope winch has a first winding which is opposed to a second winding of the actuating rope on the second rope winch.

8. The grab device according to claim 1, wherein the actuating means has an actuating carriage which is connected to the grab shovels via a linkage mechanism and the actuating carriage is displaceable along the grab frame for pivoting the grab shovels.

9. The grab device according to claim 8, wherein on the actuating carriage a pulley block arrangement is provided, with which a force increase for closing and/or opening the grab shovels can be generated.

10. The grab device according to claim 1, wherein an operating panel for manual control to actuate the rope grab and/or the rope winches is provided.

11. The grab device according to claim 1, wherein for operation a display screen for the control means is provided.

12. A method for operating a grab device, the method comprising:

providing the grab device with a carrier implement and a rope grab arranged thereon, the rope grab having a grab frame which is held on the carrier implement via a holding rope, at least two grab shovels which are pivotably supported on a lower end of the grab frame between a closed position and an open position, and an actuating means with an actuating rope for pivoting the grab shovels, wherein an actuating rope is guided from the carrier implement to the actuating means, and the carrier implement has a driven first rope winch for the holding rope and a driven second rope winch for the actuating rope, detecting a first rope force on the holding rope by means of a first detection means and a second rope force on the actuating rope by means of a second detection means, connecting the first detection means, the second detection means, the first rope winch and the second rope winch to a control means, by which, depending on the detected first rope force on the holding rope and the detected second rope force on the actuating rope, the first rope winch and/or the second rope winch are activated according to a control program specification, and activating the first and second rope winches via the control means so that a targeted turning of the rope grab about a vertical longitudinal axis is generated.

13. The method according to claim 12, wherein by means of the rope grab ground is removed and, in particular, a trench is produced in the ground.

* * * * *